United States Patent [19]

Yates

[11] Patent Number: 4,545,700

[45] Date of Patent: Oct. 8, 1985

[54] PROCESS FOR RECYCLING BITUMINOUS ASPHALT PAVEMENT

[76] Inventor: Larry A. Yates, 889 Gardendale Dr., Columbia, S.C. 29210

[21] Appl. No.: 597,205

[22] Filed: Apr. 6, 1984

Related U.S. Application Data

[63] Continuation of Ser. No. 423,490, Sep. 24, 1982, abandoned.

[51] Int. Cl.[4] ..... E01C 7/06

[52] U.S. Cl. ..... 404/75; 404/77; 404/79; 299/39

[58] Field of Search ..... 299/39; 404/72, 121, 404/123, 75, 77, 79, 91, 92, 90, 95

[56] References Cited

U.S. PATENT DOCUMENTS

| | | | |
|---|---|---|---|
| 2,053,709 | 9/1936 | Flynn | 404/90 X |
| 2,747,475 | 5/1956 | West | 404/91 |
| 3,825,361 | 7/1974 | Steiner | 404/90 |
| 3,970,404 | 7/1976 | Benedetti | 404/77 |
| 4,124,325 | 11/1978 | Cutler | 404/90 X |
| 4,226,552 | 10/1980 | Moench | 404/91 X |
| 4,261,669 | 4/1981 | Edo | 404/79 X |

FOREIGN PATENT DOCUMENTS

| | | | |
|---|---|---|---|
| 2847924 | 5/1980 | Fed. Rep. of Germany | 404/90 |
| 2846638 | 5/1980 | Fed. Rep. of Germany | 404/79 |

*Primary Examiner*—James A. Leppink
*Assistant Examiner*—Beverly E. Hjorth
*Attorney, Agent, or Firm*—F. R. Brockington

[57] ABSTRACT

A process for recycling asphalt pavement by serially heating and milling the asphalt until the desired depth of asphalt has been removed and then mixing the heated asphalt with additives, if needed, for reapplication to the pavement.

3 Claims, 3 Drawing Figures

PROCESS FOR RECYCLING BITUMINOUS ASPHALT PAVEMENT

This application is a continuation of application Ser. No. 423,490, filed Sept. 24, 1982, now abandoned.

Pavement composed of asphaltic materials ages and from time to time has to be repaired or refurbished. There are multiple inventions for accomplishing pavement repair, and those that have practical utility are well known to those familiar with the art and will not be recited here.

With increasing raw material and energy costs there has been a growing interest in trying to recycle the asphalt which is in place, thereby reducing the amount (or depth) of asphalt required for the overlay. One particularly popular method has been by scarifying the surface. The pavement is heated and then raked. The raking action pulls the unexposed asphalt to the surface where it in part mixes with the surface asphalt. In order for scarifying to be effective it is generally agreed that a depth of at least 1" of asphalt must be heated to a temperature of 225°-325° F. A depth much less than this would not dislodge a sufficient quantity of the reinforcing materials (i.e. gravel) and the percent of surface asphalt to newly exposed asphalt would be less than optimum. Also as pavement ages and the bed shifts there are many imperfections in the surface contour which are at least an inch deep and the scarifying device would pass over these areas without disturbing the surface. The more penetrating the heat the more effective the scarifying process, however even under ideal conditions scarifying tends to drag along large aggregates and reinforcing materials, mixing is incomplete and the surface still needs an overlay for cosmetic purposes.

The speed of the scarifying process is limited by the ability to heat a sufficient depth of asphalt without scorching the surface. Angelo Benedetti in his U.S. Pat. No. 3,970,404 approached the problem of heating the asphalt by stepwise exposing the asphalt with radiant heat (1800°-2500° F.) for short periods of time and then allowing the heat to transfer through the asphalt, repeating the process over and over until the desired depth (approximately 1 inch) had reached a temperature of 225°-325° F. Using this process it would require in excess of 2.5 minutes for the asphalt to reach 250° F. and a scarifying apparatus with a bed of heaters 18 feet long would travel only approximately 7 feet per minute.

The instant invention is a process in which as the asphalt becomes pliable from exposure to radiant heat it is milled from the pavement and transported to collection chutes. The milling action exposes a new relatively cooler surface of asphalt which is then reheated and milled in a cyclic fashion until the desired depth of asphalt is milled away. By using the cyclic sequence of heating and then milling away planar sections, the time period to remove a given quantity of asphalt can be significantly reduced. This is possible because the time for the asphalt, which is a relatively poor thermal conductor, to reach the desired temperature is a function of the square of the depth of material. For instance if the same 1" of asphalt is heated and then stripped in a process in which each strip is $\frac{1}{4}$" deep the total time for the four strips to be heated to 250° F. is 0.67 minutes, which is roughly $\frac{1}{4}$ the time to heat one section that is 1" thick. Thus the scarifying apparatus as described previously with an 18 foot bank of heaters equipped with mills such as those shown in FIG. 1 or 2 could travel 28 feet/minute.

The use of mills generates asphaltic material more uniform through the mixing action. The newly exposed material is actually integrally mixed with the surface asphalt and not just piled up on top of it as a scarifying operation tends to do. This in situ mixing on the pavement is a good preparative method for the addition of additives and/or other asphaltic materials. Because the exposure time to high heats is much shorter there is less scorching of the surface asphalt.

Figure 1:
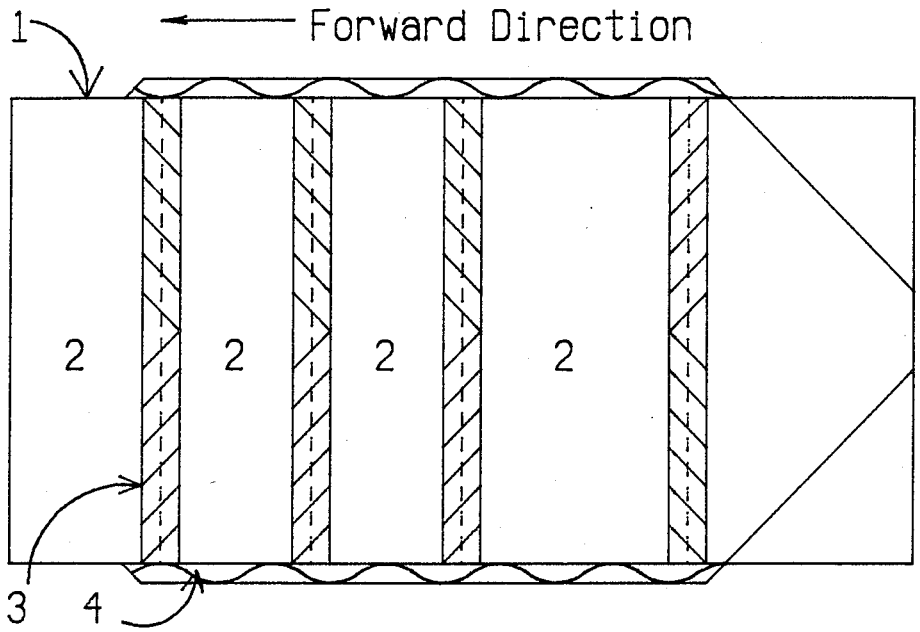
FIG. 1 illustrates a planar view of the pavement milling apparatus of the present invention.

FIG. 1 is a diagramatic planar view of an apparatus designed to mill pavement. 1 is the main frame housing for the heater banks, the right and left-handed screw mills and the collection chute assembly. 2 are radiant heater areas, 3 is one of the mills and 4 is the collection chute. The apparatus is traversing the pavement from right to left. The mills rotate against the grain of asphalt which cuts through and transports the hot pliable asphalt to the collection chutes (located on both sides) where it is conveyed to the rear of the apparatus.

Figure 2:
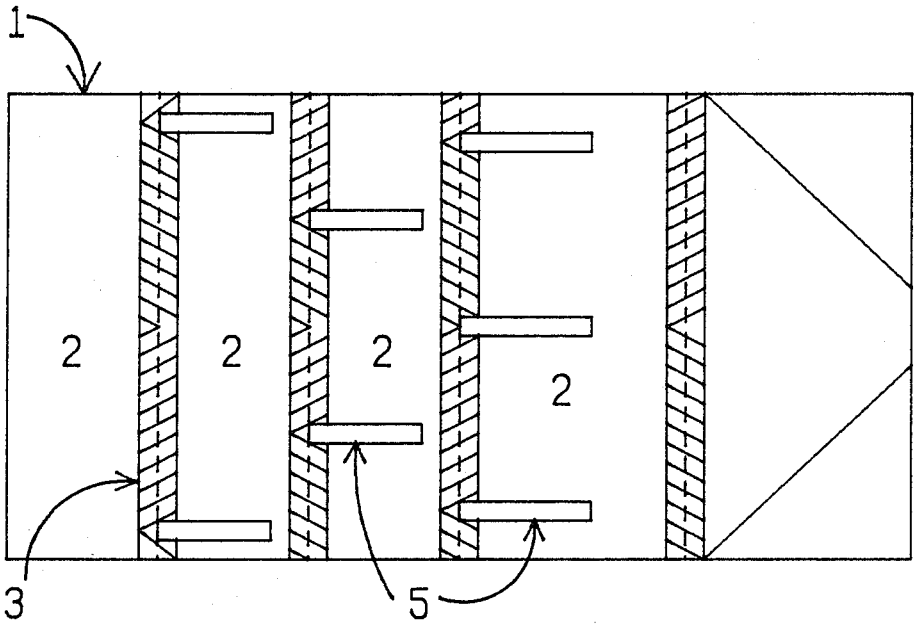
FIG. 2 shows a modification of the milling apparatus.
Figure 3:
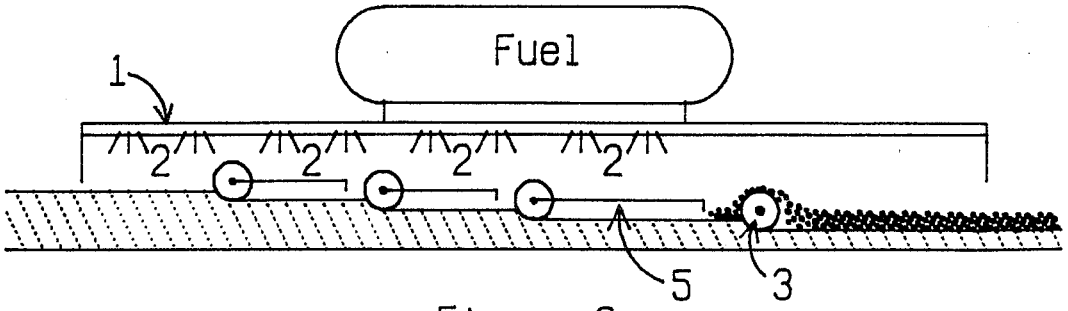
FIG. 3 is a cross-sectional view of the apparatus shown in FIG. 2.

FIG. 2 is a slightly modified version of the milling process. In the second version the mills (3) transport the pliable asphalt aggregate into collection chutes (5) for temporary vertical storage; spilling out the back of the chutes to the next mill which then moves this material along with the freshly milled material of the second stage into the trailing collection chutes. The collection chutes are staggered in their location. FIG. 3 is a cross-sectional view of the apparatus shown in FIG. 2. Note that as the asphaltic material is stripped away, the succeeding mills which are resting on the treated pavement surface fall to the lower level.

The larger the main frame obviously the more heater areas and mills can be outfitted and faster speeds can be achieved. A practical length limit of 70 feet with 10 mills is anticipated, although certain projects might justify even larger systems. The heaters will generate surface temperatures between 1500° to 3000° F.

The milling process can be adapted for intergration with additional paving equipment for leveling and compacting of the heated asphaltic materials. The three figures are embodiments of the process for milling of asphalt pavement, however it is obvious that the mills could be arranged in any number of configurations, and still simply be a minor modification of the process itself.

EXAMPLE 1

The asphalt recycling unit is a 50 foot trailer adapted for $5^{th}$ wheel coupling having a heater hood 12 feet × 30 feet and five left and right-handed screw mills. There are five radiant heating areas of four heaters (propane fired), each heater having a capacity of up to 1 million BTU/hour for a total of 20 million BTU's. The hood height is controlled hydraulically, being in the lowered position when milling. The mills are mounted under the hood with a 6 foot separation between each mill. The mills are hydraulically driven and have variable speed up to 500 revolutions/minute. The trailer has rear end steering and during milling operations the rear rubber tires are lifted off the pavement and 15" steel wheels are lowered. The first, second and fourth mills have two collection chutes for temporary vertical storage. The third mill has three chutes and the last mill feeds into a hopper through a conveyor for pick up. The apparatus can strip a depth of 1 inch of asphalt at approximately 28 feet/minute.

EXAMPLE 2

The asphalt recycling unit as described in Example 1 is equipped with a storage tank and sprayer for addition of liquid additives. The sprayer nozzel is located just forward of the last mill.

EXAMPLE 3

The asphalt recycling unit is as described in Example 1 except that the collection chutes are located on the side. The first four mills each feed from the middle to the right and left side of the apparatus to the chutes on either side. Each collection chute guides materials back into the collection hopper. The last mill feeds from the sides to the middle where the asphalt passes back to the hopper where it joins the material from the collection chutes.

EXAMPLE 4

The asphalt recycling unit is as described in Example 3 with the exception that solid asphaltic materials are fed into the collection chutes to be blended with the milled asphalt as the blend moves through the auger.

What I claim is:

1. A process for recycling asphalt pavement from a road surface by heating, milling and mixing in which an apparatus either drawn pushed or self propelled uses a series of heaters and mills to sequentially strip away relatively thin layers of asphalt pavement to a desired depth for recycling of the asphalt pavement, said process comprising in a single pass of a single machine, the steps of:

(a) heating an upper layer of the asphalt pavement to be recycled to a depth of at least one quarter of an inch to render the upper layer of asphalt pliable;

(b) following said step of heating, milling of the upper layer of the pliable asphalt with a screw auger resting upon the upper layer of the pliable asphalt and thereby, removing the upper layer of pliable asphalt from the road surface (c) during said step of milling and removing, simultaneously mixing the removed pliable upper layer of asphalt from the road surface, in situ, with the screw auger;

(d) collecting said pliable layer of asphalt into at least one chute and, exposing an underlying layer of cooler asphalt to be heated;

(e) heating the underlying layer of cooler asphalt to a depth of at least one quarter of an inch to render the upper layer of the underlying asphalt pliable;

(f) repeating steps (b), (c), and (d), and step (e) in all but the last sequence of a multiple sequence until at least one inch of the asphalt pavement is removed from the road surface;

(g) treating the removed asphalt pavement with an additive; and (h) reapplying the mixed and treated layers of asphalt to the road surface, for surfacing the road with recycled asphalt pavement.

2. A process for recycling asphalt pavement from a road surface by heating, milling and mixing as defined in claim 1 wherein said step of milling, removing and simultaneously mixing comprises the steps of:

augering removed material from the middle to the sides of the apparatus, and guiding removed and mixed material back to a collection hopper.

3. A process for recycling asphalt pavement from a road surface by heating, milling and mixing as defined in claim 1 wherein said step of milling, removing and simultaneously mixing comprises the steps of:

augering removed material from the sides of the apparatus to at least one interior position of the apparatus, and guiding removed and mixed material back to a collection hopper.

* * * * *